US007794367B2

(12) United States Patent
Hall et al.

(10) Patent No.: US 7,794,367 B2
(45) Date of Patent: Sep. 14, 2010

(54) FOOT EXERCISER AND ASSOCIATED METHODS

(75) Inventors: Richard Stephen Hall, Port Moody (CA); Matthew Earle Crozier Ferguson, Port Moody (CA); Jordan Aldon Myers, Coquitlam (CA); Christopher Grant Denny, Victoria (CA)

(73) Assignee: Progressive Health Innovations Incorporated, Port Moody, CA (US)

( * ) Notice: Subject to any disclaimer, the term of this patent is extended or adjusted under 35 U.S.C. 154(b) by 365 days.

(21) Appl. No.: 11/908,122

(22) PCT Filed: Mar. 8, 2006

(86) PCT No.: PCT/CA2006/000339

§ 371 (c)(1),
(2), (4) Date: Sep. 7, 2007

(87) PCT Pub. No.: WO2006/094397

PCT Pub. Date: Sep. 14, 2006

(65) Prior Publication Data

US 2009/0270231 A1 Oct. 29, 2009

Related U.S. Application Data

(60) Provisional application No. 60/659,270, filed on Mar. 8, 2005.

(51) Int. Cl.
*A63B 23/10* (2006.01)
*A63B 21/04* (2006.01)

(52) U.S. Cl. ..... 482/79; 482/129

(58) Field of Classification Search ..... 482/79, 482/80, 124, 146, 147; 36/68, 144; 601/27; 602/23; 182/129, 130
See application file for complete search history.

(56) References Cited

U.S. PATENT DOCUMENTS

| | | | | | |
|---|---|---|---|---|---|
| 1,399,606 | A | * | 12/1921 | Ferragamo | 602/23 |
| 1,671,096 | A | * | 5/1928 | Anderson | 482/79 |
| 2,250,493 | A | * | 7/1941 | Milne | 482/79 |
| 2,760,774 | A | * | 8/1956 | Perez | 482/79 |
| 3,295,847 | A | * | 1/1967 | Matt, Sr. | 482/80 |
| 3,421,760 | A | * | 1/1969 | Freeman, Jr. | 482/80 |
| 3,741,540 | A | * | 6/1973 | Shimizu | 482/80 |
| 4,728,103 | A | * | 3/1988 | Fulton | 482/125 |
| 4,862,875 | A | * | 9/1989 | Heaton | 601/26 |

(Continued)

*Primary Examiner*—Loan Thanh
*Assistant Examiner*—Allana Lewin
(74) *Attorney, Agent, or Firm*—Oyen Wiggs Green & Mutala LLP

(57) ABSTRACT

A foot, toe, and ankle exercise device provides variable resistance to movements in multiple directions. The device comprises a flexible forefoot support to allow for full toe and foot range of motion. The forefoot support includes a raised surface under the toes used to help align anatomical landmarks to delineate the resistance for the toes from that of the foot/ankle. Resistance may be provided by elastic banding or tubing that is mounted on an octagonal frame. Tensioners are provided to adjust the magnitude of the resistance. A height adjustable heel cup is mounted on a horizontal track to adjust the apparatus for use by different users with different size feet. A vertical track is provided to raise or lower the forefoot support and system of elastic banding or tubing so that full range movements are possible. In another version of the invention, inelastic banding along with weights is used to provide resistance.

25 Claims, 9 Drawing Sheets

U.S. PATENT DOCUMENTS 5,100,129 A * 3/1992 Porter et al. ..... 482/129
5,645,516 A * 7/1997 Foster ..... 482/79
5,746,687 A * 5/1998 Vial et al. ..... 482/126
6,277,057 B1 * 8/2001 Hayden ..... 482/79
6,283,897 B1 * 9/2001 Patton ..... 482/79
6,312,361 B1 * 11/2001 Hayes ..... 482/51
6,692,415 B1 * 2/2004 Winston ..... 482/126
6,796,928 B1 * 9/2004 Christopher et al. ..... 482/51
7,322,914 B1 * 1/2008 Vittone et al. ..... 482/146
2005/0043150 A1 * 2/2005 Nitta et al. ..... 482/79

* cited by examiner

FOOT EXERCISER AND ASSOCIATED METHODS

CROSS REFERENCE TO RELATED APPLICATION

This application claims priority under the Paris Convention from U.S. patent application No. 60/659,270 filed on 8 Mar. 2005 and entitled FOOT EXERCISER AND ASSOCIATED METHODS. For purposes of the United States of America, this application claims the benefit of U.S. patent application 60/659,270 pursuant to 35 U.S.C. §119. The said U.S. patent application No. 60/659,270 is hereby incorporated herein by reference.

TECHNICAL FIELD

This invention relates to exercise apparatus and, more specifically, to apparatus for exercising muscles, tendons, ligaments and/or other tissues related to the foot, toes, and/or ankle.

BACKGROUND

The foot and ankle are often overlooked in exercise programs, yet feet and ankles are extremely important areas of the body. Unfortunately, injuries to the foot or ankle are common in a variety of sports, work activities, or activities of daily living. Many treatment methods are available to deal with foot and ankle injuries (chiropractic adjustments, inflammation-reduction treatments such as ultrasound or microcurrent, range of motion exercises, coordination and balance exercises such as wobble board, strengthening exercises using resistive strength equipment, orthotics, etc.). However, none of the treatments or devices commonly utilized in the health care and exercise fields offers a complete range of exercises to properly strengthen the foot and ankle in isolation or in a combination of movements.

Balanced strengthening of the foot and ankle requires resistance exercises in multiple directions. Performing calf raises using body weight as resistance or with strength training equipment will strengthen the foot and ankle in plantar flexion; however, this results in unidirectional strengthening only. Various health practitioners recommend that patients grasp towels with their toes to strengthen the plantar musculature of the foot. Although this provides some resistance, it is cumbersome and there is no opportunity to increase or monitor the resistance. Progressive increases in resistance are important to allow for strengthening of the associated musculature. Although conventional elastic tubing apparatus can provide resistance to strengthen the foot in simple directions such as dorsiflexion, it is difficult to properly orient the tubing to strengthen the foot and ankle in multiple directions. Furthermore, it is sometimes difficult to apply the tubing to the foot so that the resistance is applied in the appropriate direction (e.g. sub-talar inversion/eversion).

Currently prevalent foot-strengthening techniques can help to strengthen the foot somewhat; however, these techniques are typically limited by one or more of:

- inadequate activation of the intrinsic musculature that controls movement of the foot and toes,
- difficulty in set-up of the apparatus and anatomical landmarking,
- lack of progressive resistance,
- lack of a way to measure resistance, and
- unidirectional strengthening.

Foot and ankle exercising devices in the patent literature include:

- Johnson et al., U.S. Pat. No. 6,821,235 which discloses a foot-engaging element that can move in a spherical pattern and has elastic straps that provide resistance to movement.
- Kucharik et al. U.S. Pat. No. 4,739,986 discloses a foot ankle and lower leg exerciser that has two foot pedals mounted on a bar. A lower end of the bar has a ball joint that allows the foot pedals to be moved. A spring provides resistance to movement.
- Firster, U.S. Pat. No. 3,984,100 discloses a foot exerciser having a foot support to which can be attached weights or the like. A rounded member under the foot support allows the foot support to be pivoted relative to the floor.
- Kost, U.S. Pat. No. 2,206,902 discloses a device having foot platforms pivotally mounted to a base.
- Mason et al., U.S. Pat. No. 5,186,698 discloses an ankle exercise system comprising an elastic strap that can be attached to a user's forefoot.
- Aberton et al., U.S. Pat. No. 6,540,651 discloses exercise apparatus having a sock-like attachment structure. The attachment structure can be worn on a foot and has several different places to which one end of a resistance member can be attached. Another end of the resistance member can be attached to a structure;
- Williams, U.S. Pat. No. 4,371,161 discloses a foot exerciser having an elastic member extending between a foot-encircling strap and a brace attached to a user's lower leg;
- Fulton, U.S. Pat. No. 4,728,103 discloses a leg and ankle exercising device comprising a plate attached to handles by elastic limbs;
- Dyer, U.S. Pat. No. 6,110,078 discloses a device for stretching the foot. The device has two plates hinged together and a variable tensioning mechanism connected between the plates;
- A selection of other devices for exercising the foot and/or lower leg are disclosed in: Stodgell, U.S. Pat. No. 5,368,536; McLeod, U.S. Pat. No. 5,897,464; McIlvain et al. U.S. Pat. No. 5,749,668; Commisso, U.S. Pat. No. 6,878,102; Vathappallil, U.S. Pat. No. 6,063,013; Howd et al. U.S. Pat. No. 6,063,010; Foster, U.S. Pat. No. 5,645,516; Perez, U.S. Pat. No. 5,618,247; Jennings, U.S. Pat. No. 5,836,587; Kheiralla, U.S. Pat. No. 539,872; Porter et al., U.S. Pat. No. 5,100,129; Bastow, U.S. Pat. No. 5,1215,508; McIntyre, U.S. Pat. No. 5,178,596; Hoyle et al., U.S. Pat. No. 4,337,939; White, U.S. Pat. No. 4,310,155; Freeman Jr., U.S. Pat. No. 3,421,760; Matt Sr., U.S. Pat. No. 3,295,847; Loomis et al. U.S. Pat. No. 4,306,714; Scott, U.S. Pat. No. 4,998,722; Muller, U.S. Pat. No. 843,478; Anderson, U.S. Pat. No. 1,671,096; Gailey, U.S. Pat. No. 1,952,750; Marshman, U.S. Pat. No. 2,097,376; Cunningham, U.S. Pat. No. 2,160,722; Leseberg, U.S. Pat. No. 4,251,070; Knight, U.S. Pat. No. 6,390,957; Kock, U.S. Pat. No. 4,979,737; Ostergard, U.S. Pat. No. 4,767,118; Lepley et al., U.S. Pat. No. 4,452,447; McIntyre, U.S. Pat. No. 4,650,183; Fiore et al., U.S. Pat. No. 4,186,920; and Timmer, U.S. Pat. No. 6,811,523.

There is a need for effective, practical apparatus and methods for strengthening muscles of the foot and ankle.

BRIEF DESCRIPTION OF THE DRAWINGS

In drawings which illustrate non-limiting example embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

This invention provides an exercise apparatus that may be used to exercise muscles of the foot and/or lower leg of a user. The exercise apparatus may be useful in any of a wide variety of settings from rehabilitation settings to gymnasia to home exercise. The exercise apparatus may be used for exercising the muscles of a wide variety of users including athletes (e.g. for injury prevention, improved performance), persons who are recovering from foot or ankle injuries, people who want to be in good overall shape, people who suffer from low strength of the muscles of the foot and ankle, and people who have poor balance.

Apparatus according to the invention may take various forms for use in different environments. For example, apparatus for use in a rehabilitation setting may require greater adjustability and be constructed to withstand more constant use than exercise apparatus according to the invention for use at home.

Figure 1:
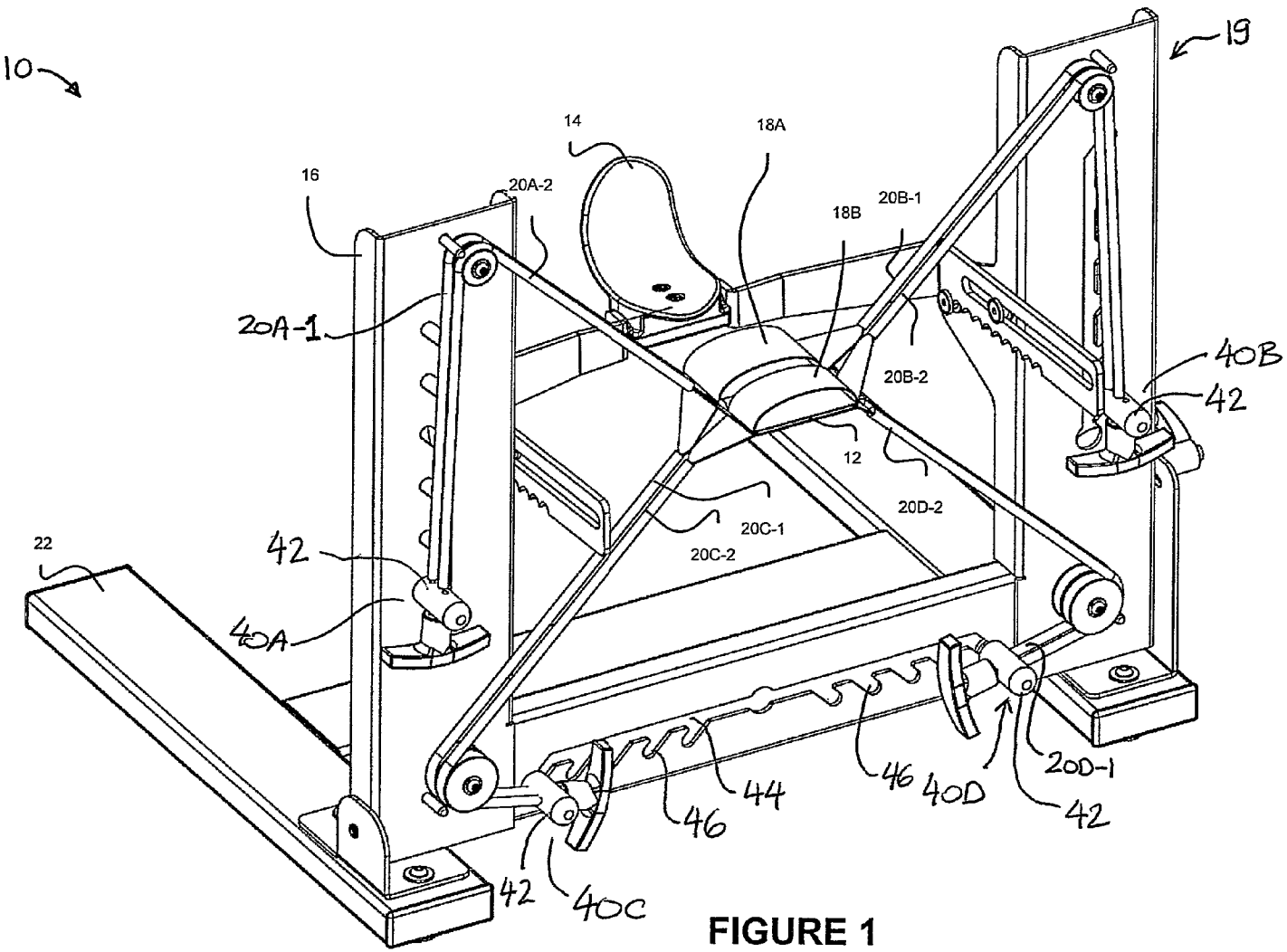
FIG. 1 is an isometric view of a foot exercise apparatus according to an embodiment of the invention.
Figure 1A:
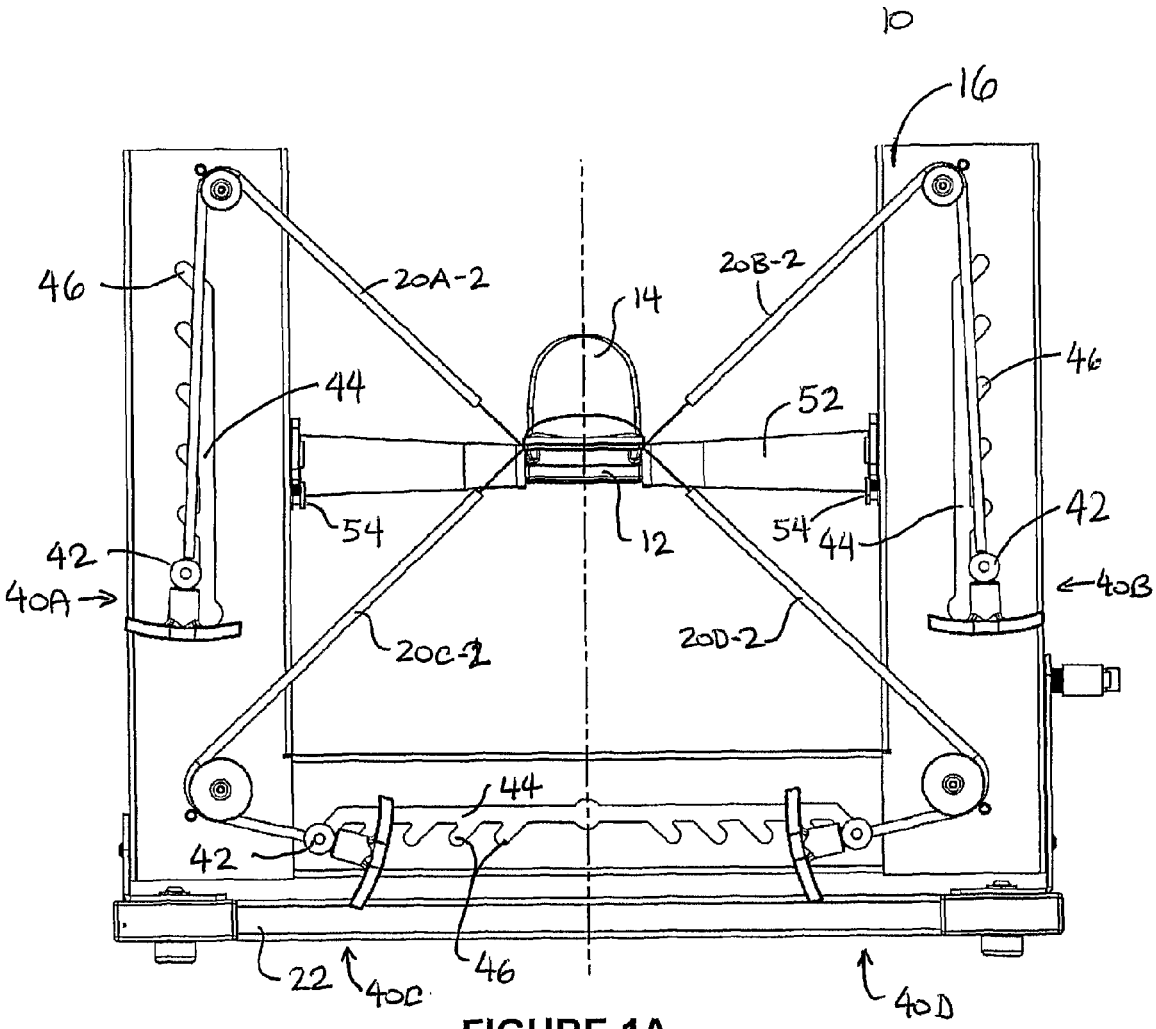
FIG. 1A is a front elevation view of the foot exercise apparatus of FIG. 1.
Figure 1B:
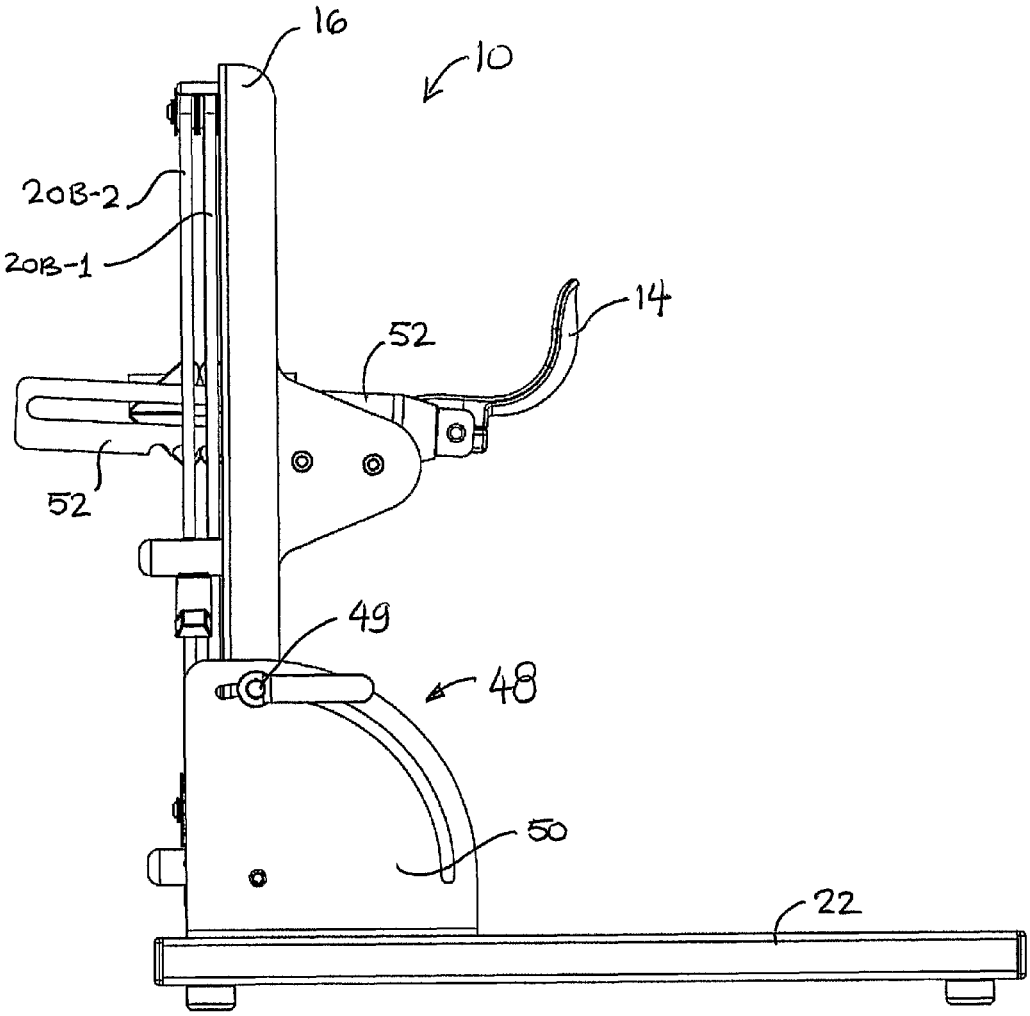
FIG. 1B is a side elevation view of the foot exercise apparatus of FIG. 1.
Figure 1C:
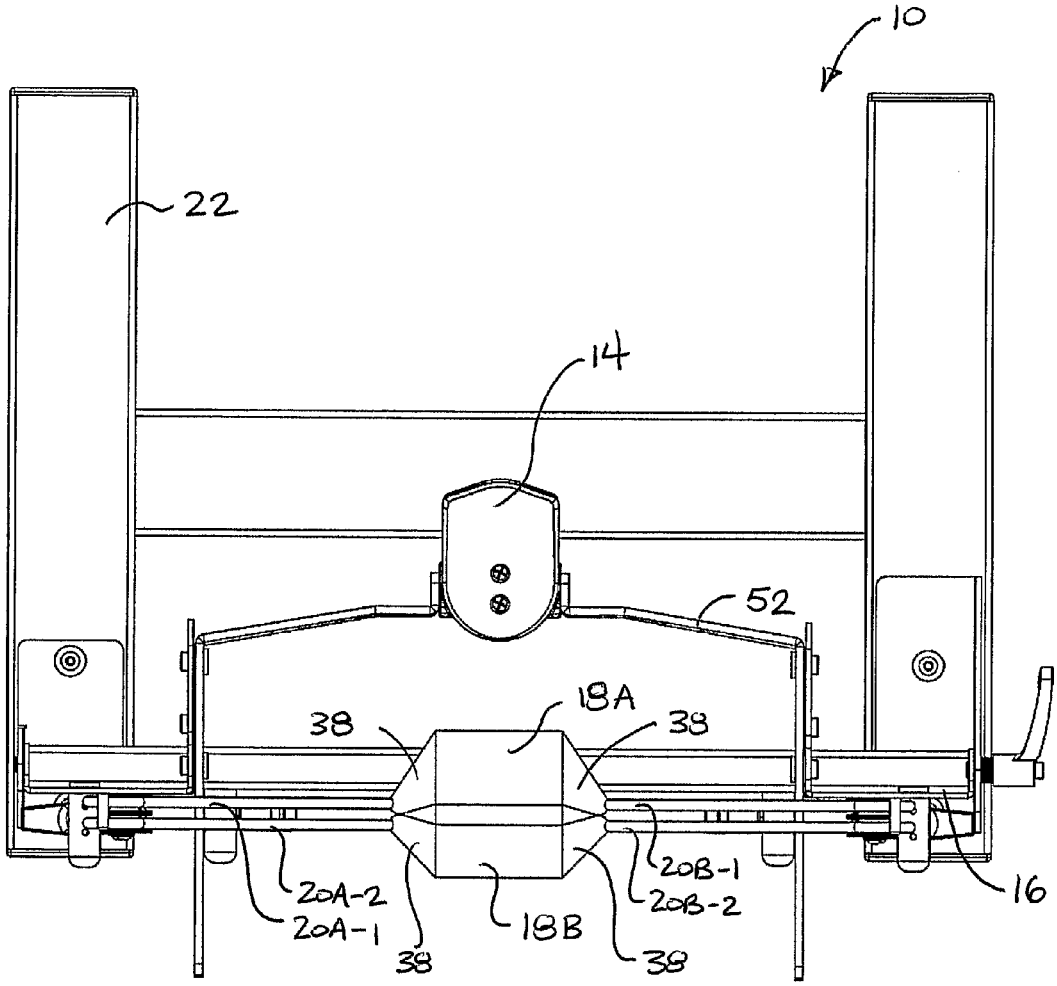
FIG. 1C is a top plan view of the foot exercise apparatus of FIG. 1.

FIG. 1 illustrates a foot exercise apparatus 10. FIGS. 2A to 2E illustrate various movements of the foot and ankle that may take place while a user is using exercise apparatus 10.

Apparatus 10 comprises a forefoot member 12 and a heel support 14 mounted to a frame 16. A resistance system 19 provides resistance to motion of forefoot member 12. In apparatus 10, resistance system 19 comprises eight resistance members 20. Forefoot member 12 is suspended from frame 16 by resistance members 20A-1, 20B-1, 20C-1, 20D-1, 20A-2, 20B-2, 20C-2, and 20D-2 (collectively resistance members 20). Forefoot member 12 has straps 18 that can be used to strap a user's foot to forefoot member 12. In the illustrated embodiment, there are two straps 18A and 18B that can be adjusted to hold a user's forefoot and toes to forefoot member 12. A frame 16 is supported by a base 22.

A user can use apparatus 10 by placing his or her foot on heel support 14 and fastening straps 18A and 18B to hold the user's forefoot and toes to forefoot member 12. The user can then move his or her foot in various ways against the resistance provided by resistance members 20 to exercise the user's foot, ankle and/or toes as described in more detail below. FIGS. 2A to 2D show various foot motions that a user can perform while using apparatus 10.

As forefoot member 12 is suspended from frame 16 by resistance members 20 it can be moved in any direction in the plane of frame 16. Resistance members 20 provide resistance to such motion. Resistance members 20 also provide forces that resist motions of forefoot member 12 out of the plane of frame 16. In the illustrated embodiment, when forefoot member 12 is in its neutral position, resistance members 20 are substantially coplanar, although this is not mandatory.

Figure 3:
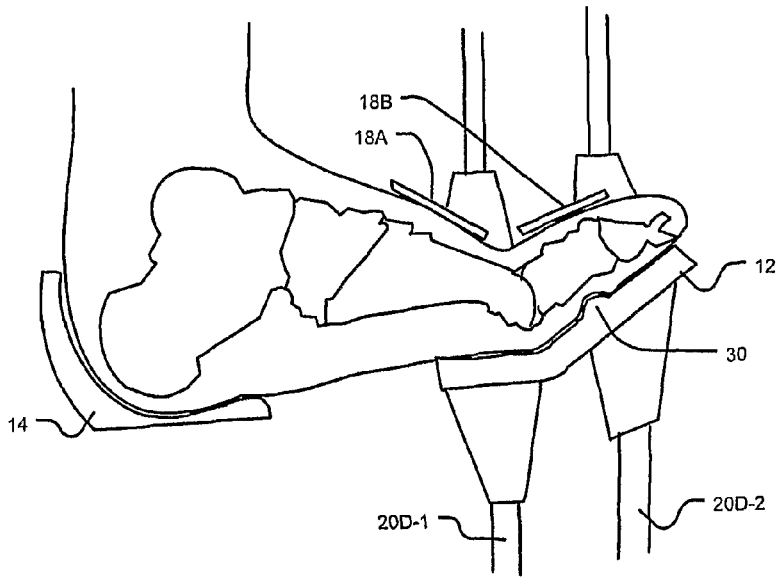
FIG. 3 is a longitudinal elevational sectional view of an apparatus like that of FIG. 1 applying resistance to toe extension of a user's foot.
Figure 3A:
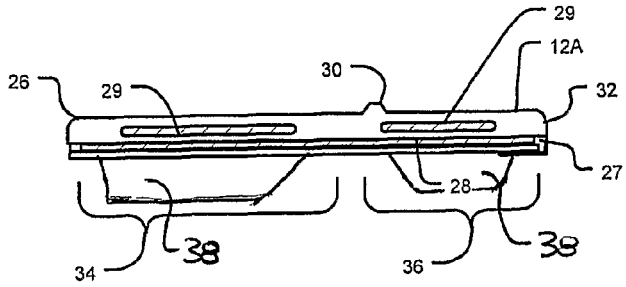
FIG. 3A is a longitudinal elevational sectional view of a forefoot support.

As shown in FIG. 3A, forefoot member 12 provides a surface 26 on which a user can place the user's forefoot. Forefoot member 12 may be flexible about a transverse axis so that it can bend under the pressures applied by a user's foot and toes to allow a full range of motion of the user's foot and toes. Preferably, forefoot member 12 is flexible all along its length so that it interferes minimally with rotations of the IP joints in the toes and the MTP joints in the forefoot. These joints are typically not uniform in terms of their position along the length of the foot. In preferred embodiments, forefoot support 12 is also at least somewhat flexible in the medial-lateral (torsional) direction.

In the alternative, forefoot member 12 may be semi-rigid or rigid to isolate specific joint movements. In some embodiments, forefoot member 12 comprises a removable stiffener that extends longitudinally along forefoot member 12. The stiffener may be inserted to increase the stiffness of forefoot member 12 in respect of bending moments about transversely-extending axes or removed to make forefoot member 12 more flexible. Different stiffeners may be provided to achieve different degrees of flexibility. For example, as shown in FIG. 3A, a forefoot member 12A has a longitudinally-extending pocket 27 that receives a removable stiffener 28. A stiff stiffener 28 can prevent relative movements of the foot and toes. This can be desirable to isolate ankle movements. Forefoot member 12 may be stiffened by a plate or the like that sits under the foot or attaches to a lower surface of forefoot member 12 in the alternative to an internal stiffener 28.

Forefoot member 12 may be reinforced in certain areas. For example, forefoot member 12 may be reinforced in the general vicinity of a user's distal metatarsals (MT) and distal/middle phalanges (DP/MP) to allow for force transfer to the user's foot and toes from resistance members 20. FIG. 3A shows reinforcements 29 that extend transversely across forefoot member 12.

Forefoot member 12 may have an upwardly-projecting foot-locating feature on a superior surface (e.g. surface 26) of the forefoot member 12. The foot-locating feature may comprise a ridge 30 on the superior aspect of forefoot support 12 toward the distal end (i.e. the end 32 which receives the toes of the user's foot) of forefoot support 12. In the illustrated embodiment, ridge 30 traverses the width of forefoot support 12 (see FIG. 3A). Ridge 30 helps a user to align his or her foot on forefoot support 12. The user can align the approximate mid-point of the proximal phalange of the great toe with the center of ridge 30 (see FIG. 3). By placing the toes over ridge 30, proper alignment of the distal metatarsals (MT) joints with respect to the forces that resist motions of the foot/ankle as well as alignment of the phalanges with respect to the forces that resist motions of the toes can readily be achieved.

In preferred embodiments, apparatus 10 is constructed to permit the resistance forces applied to a user's toes to be different from the resistance forces applied to a user's foot/ankle. Ridge 30 may be located such that the user's foot and toes are positioned to experience these different resistance forces when the user moves his or her foot and toes to move forefoot member 12 in various directions.

In the illustrated foot exerciser, resistance members 20 comprise elastic members, such as elastic tubes or bands, connected between forefoot member 12 and frame 16. Resistance members 20 may be connected to forefoot member 12 in any suitable way. For example, in apparatus 10, flexible tabs 38 of durable material such as: neoprene, a strong fabric, or the like are attached to forefoot member 12 by stitching, laminating, riveting or the like. Resistance members 20 are each attached to an end of a tab 38. Tabs 38 may be tapered, as shown. Tapered tabs 38 distribute forces evenly under a user's toes and distal metatarsal bones. Tabs 38 may comprise the transversely-projecting ends of strips of material that extend transversely across forefoot member 12. The material may be substantially inelastic.

The tabs 38 in forward area 36 of forefoot member 12 may have sufficient width that they act on forefoot member 12 over areas that extend longitudinally on forefoot support 12 for distances sufficient to accommodate differences in the length of toes of different users. For example, in some embodiments of the invention, portions of tabs 38 that pass under forefoot support 12 have widths in the range of about 5 cm to 6 cm.

Other suitable means may be provided to attach resistance members 20 to forefoot member 12. For example, resistance members 20 may pass through tunnels, sleeves, or similar passageways under or through forefoot member 12.

Resistance system 19 resists motion of forefoot member 12. Resistance system 19 may provide different levels of resistance for motions of different parts of forefoot support 12. In the embodiment illustrated in FIG. 1, resistance system 19 provides different amounts of resistance for motions of a rear portion 34 and a front portion 36 of forefoot member 12. Since the muscles that move the foot are typically stronger than the muscles that move the toes, resistance system 19 preferably provides greater resistance to movement of rear portion 34 than it does for movement of front portion 36.

In the illustrated embodiment, a first set of resistance members 20A-1, 20B-1, 20C-1, 20D-1 acts on forefoot member 12 at a longitudinal location approximately corresponding with the distal metatarsals. A second set of resistance members 20A-2, 20B-2, 20C-2, 20D-2 acts on forefoot member 12 at a longitudinal location approximately corresponding with the mid-point of the proximal phalanges of the user's first three toes.

In each set of resistance members, some resistance members 20 extend in a superior direction relative to forefoot member 12 and some other resistance members 20 extend in an inferior direction relative to forefoot member 12. Resistance members 20A-1, 20B-1, 20A-2 and 20B-2 extend in a superior direction (as well as extending outwardly on opposite sides of forefoot member 12). Resistance members 20C-1, 20D-1, 20C-2 and 20D-2 extend in an inferior direction (as well as extending outwardly on opposite sides of forefoot member 12). In the illustrated embodiment, the resistance members 20 of each set extend in directions that are separated by approximately 90 degrees so that resistance members 20 can provide resistance through a complete range of 360 degrees. In the illustrated embodiment, each of resistance members 20 extends at an angle of roughly 45 degrees to the general plane of forefoot member 12 and is coupled to frame 16 at locations that are about 45 degrees above or below the general plane of forefoot member 12.

Resistance members 20A-2 and 20B-2 provide resistance when a user flexes his or her toes. These resistance members act on forefoot member 12 in an area that is distal to ridge 30. Resistance members 20A-2 and 20B-2 are connected to frame 16 at locations that are superior to forefoot member 12.

Resistance members 20C-2 and 20D-2 provide resistance when a user extends his or her toes. These resistance members act on forefoot member 12 in an area that is distal to ridge 30 and are coupled to frame 16 at locations that are inferior to forefoot member 12.

Resistance members 20A-1 and 20B-1 provide resistance for foot flexion, forefoot abduction/adduction, ankle inversion/eversion, ankle plantar flexion, and combinations of these movements. These resistance members act on forefoot support 12 in an area that is proximal relative to ridge 30. Resistance members 20A-1 and 20B-1 are coupled to frame 16 at locations superior to forefoot member 12.

Resistance members 20C-1 and 20D-1 provide resistance for foot extension, forefoot abduction/adduction, ankle dorsiflexion, ankle inversion/eversion, and combinations of these movements. These resistance members act on forefoot member 12 in an area proximal relative to ridge 30. Resistance members 20C-1 and 20D-1 are coupled to frame 16 at locations inferior to forefoot member 12.

Elastic members 20A-1, 20B-1, 20C-1 and 20D-1 may all act on the same area of forefoot member 12. Elastic members 20A-2, 20B-2, 20C-2 and 20D-2 may all act on the same area of forefoot member 12. In the illustrated embodiment, forefoot member 12 is flexible at least in some part or all of the portion between the area on which resistance members 20A-1, 20B-1, 20C-1 and 20D-1 act and the area on which resistance members 20A-2, 20B-2, 20C-2 and 20D-2 act. This permits different resistance forces to be applied to toe flexion and ankle plantarflexion, for example.

The positions at which resistance members 20 connect to forefoot member 12 may be chosen so that they are suitable for accommodating a wide range of foot sizes. In some embodiments resistance members 20A-2 to 20D-2 are positioned at a point on forefoot member 12 forward from foot-locating feature 30 by a distance corresponding to the length of the distal phalange of the great toe for 5th percentile U.S. females. Providing elastic members 20A-2 to 20D-2, which act on forefoot member 12 at this position, also accommodates a wide range of users with longer toes.

In some embodiments of the invention the locations at which resistance members 20 act on forefoot member 12 are adjustable. For example, a series of tunnels, sleeves, grommets, clips, or the like may be provided at different locations along the portion of forefoot member 12 that supports the toes of users (portion 36 in FIG. 3A) and/or the portion of forefoot member 12 that supports the forefeet of users (portion 34 in FIG. 3A). Resistance members 20 can be connected to forefoot member 12 at selected ones of these locations that are suitable for the geometry of the user's foot and toes.

In some embodiments of the invention forefoot member 12 includes attachment points for additional resistance members (such as elastic bands or tubes, for example). Such additional resistance members may be connected between forefoot support 12 and frame 16 to provide increased resistance to motions of a user's ankle during ankle plantarflexion.

Resistance members 20 may be designed to provide different levels of resistance so that the resistance is roughly matched to the strength of the muscle groups used to push or pull against the resistance. Based on known strength ratios between the various joint movements, resistance members 20A-2 to 20D-2 may be designed to provide approximately ⅓ the resistance of resistance members 20A-1 and 20B-1. Resistance members 20C-1 and 20D-1 may provide approximately ½ the resistance of resistance members 20A-1 and 20B-1. By way of example, where the resistance members are elastic members, the resistance members may comprise elastic members having different elastic constants and/or elastic members of different lengths and/or tensions to achieve the desired differences in resistance.

In the embodiment of FIG. 1, one end of each elastic resistance member 20 is attached to a tensioner 40 (individually labeled 40A, 40B, 40C, and 40D). Tensioners 40 permit adjustment of the tension on resistance members 20. The resistance that apparatus 10 provides to different foot, toe and ankle movements can be adjusted by appropriately setting the tension in the different resistance members 20. In apparatus 10 of FIG. 1, tensioner(s) 40 are located along the side and bottom parts of frame 16.

Any suitable mechanisms may be provided to permit adjustment of the tension in resistance members 20. For example, tensioners 40 may comprise handles 42 that can be engaged in a selected branch 46 of a slot 44 as shown in FIG. 1.

In foot exercise apparatus 10 of FIG. 1, each tensioner 40 simultaneously tensions one resistance member 20 of both sets of resistance members. For example, tensioner 40A simultaneously sets the tension of resistance members 20A-1 and 20A-2.

Other tensioner mechanisms which pull an end of a member 20, vary a force applied to an end of a member 20, or the like can be used for tensioners 40. Other mechanisms that could be provided to selectively tension resistance members 20 include, without limitation:

- Ratcheting capstans around which resistance members 20 may be wound. In an example embodiment (not shown) each tensioner 40 comprises a shaft slotted to allow an end of a resistance member 20 to pass through the shaft. The shaft can be rotated to wind the resistance member around the shaft. A ratchet mechanism holds the shaft to keep a desired tension in the resistance member 20. A handle permits a user or clinician to turn the shaft to adjust tension in the elastic member 20.
- An enlargement, such as a rubber ball, attached to the end of an elastic member 34. The elastic member may be tensioned by sliding the rubber ball along a slot and engaging the elastic member in one of a plurality of recesses extending substantially transverse to the slot. The enlargement (e.g. the rubber ball) prevents the end of the elastic member from being pulled through the slot.
- A hook or the like on the end of a resistance member 20 that can be engaged in different apertures to allow for incremental levels of resistance.
- An end of a resistance member 20 may be attached to an anchor that can be moved along a track in one direction to stretch the resistance member 20 (thereby increasing the tension in the resistance member 20) or in another direction to allow the resistance member to contract (thereby reducing the tension in the resistance member 20). The anchor may be moved: manually (as, for example, handles 42 of FIG. 1), by rotation of a screw; by a suitable linear actuator; by operation of a motor or the like.
- An end or other portion of a resistance member 20 may be wound around a shaft or the like.
- A resistance member 20 may be moved or displaced so that it follows a longer path between an anchor point and forefoot member 12.
- etc.

Tensioners may be connected to adjust the resistance provided by any convenient combination of resistance members 20. For example:

- separate tensioners may be provided for the two sets of resistance members (20A-1 through 20D-1- and 20A-2 through 20D-2);
- separate tensioners may be provided for individual resistance members 20;
- a single tensioner may be provided to simultaneously tension all of the resistance members; one set of the resistance members or some subset of the resistance members.

In one non-illustrated example embodiment, a first tensioner is provided for adjusting tension in the first set of resistance members (20A-1 to 20D-1); a second tensioner is provided for adjusting tension in the second set of resistance members (20A-2 to 20D-2). This arrangement permits adjustment of the resistance to toe motions separately from the resistance to foot/ankle motions. A third tensioner may be provided to simultaneously increase or decrease tension in all of resistance members 20.

In apparatus according to some alternative embodiments of the invention, resistance is adjusted by removing and replacing resistance members 20 with different resistance members 20 that provide different resistance levels or by adding (or taking away) additional resistance members (not shown) connected substantially in parallel with resistance members 20. Either of these alternative adjustment mechanisms may be provided instead of, or in addition to, a mechanism for adjusting the tension in individual resistance members 20.

Apparatus 10 may optionally include a scale that indicates the tension in some or all of resistance members 20. The scale may be associated with one or more of tensioners 40. Tension gauges (not shown) may be mounted inline with some or all of resistance members 20 to give feedback to the clinician/user on the magnitude of tension generated during specific joint movements.

Frame 16 is constructed from a strong material such as high-strength plastic, metal or the like. In the illustrated embodiment, frame 16 is U-shaped. This is not mandatory. In alternative embodiments of the invention, frame 16 could have other shapes and dimensions suitable for supporting resistance members 20.

Frame 16 of apparatus 10 is pivotally mounted to base 22. An angle adjustment mechanism 48 permits the angle between frame 16 and base 22 to be adjusted. A user may use apparatus 10 with frame 16 extending substantially vertically, as shown in FIG. 1, or with frame 16 tilted to another angle relative to base 22. This facilitates the use of apparatus 10 by people who are in sitting or supine positions. For example, frame 16 could be tilted back to allow apparatus 10 to be used effectively when a user's lower leg is angled backward, as when sitting on a low chair or couch.

In the illustrated embodiment, adjustment mechanism 48 comprises a locking handle 49 that can be turned to clamp frame 16 to a plate 50 at a desired angle to base 22. A scale may be provided to allow the angle of frame 16 to be readily determined. In some embodiments, heel support 14 may be removed and frame 16 may be folded down until it lies along base 22 for storage purposes. Tilting of a foot exercise apparatus could also be accomplished by providing extendable legs or some other mechanism for tilting base 22 relative to the ground.

Figure 1D:
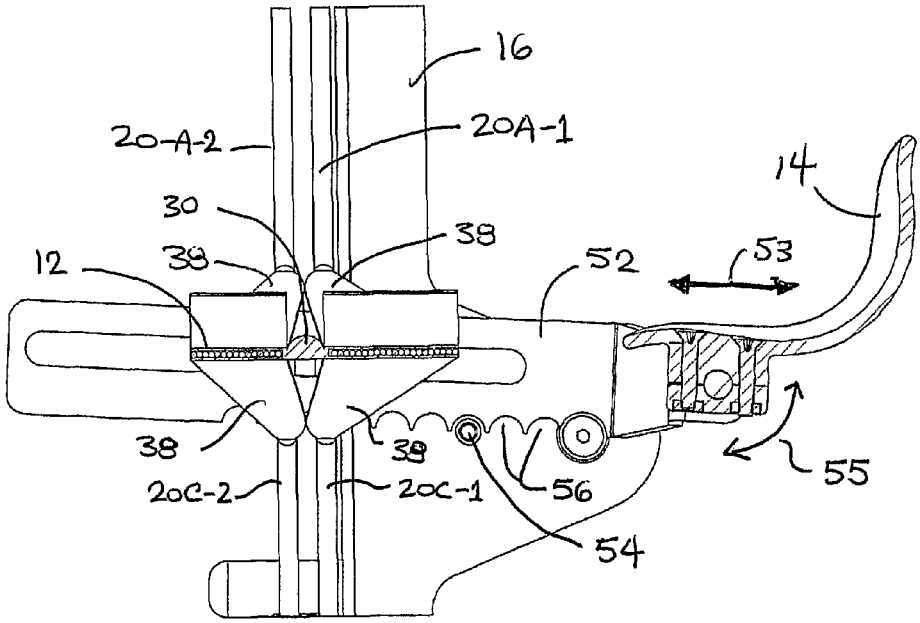
FIG. 1D is a partial elevational cross section through a forefoot support and heel support of the foot exercise apparatus of FIG. 1.
Figure 2E:
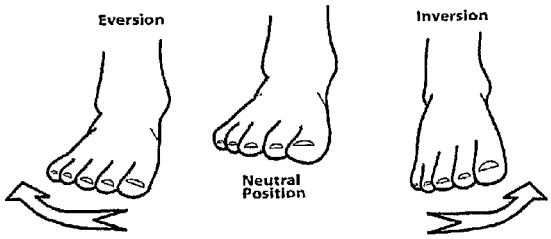
FIGS. 2A through 2E show various movements of the foot and ankle that may take place while a user is using exercise apparatus like that of FIG. 1.
Figure 2D:
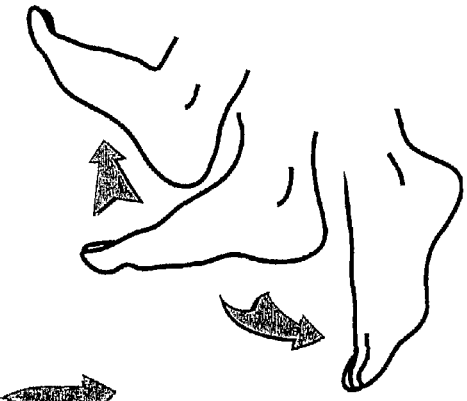
Figure 2B:
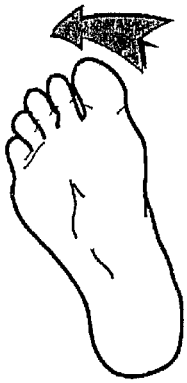
Figure 2A:
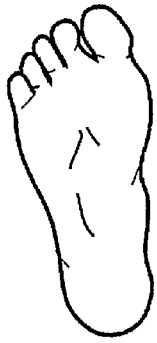
Figure 2C:
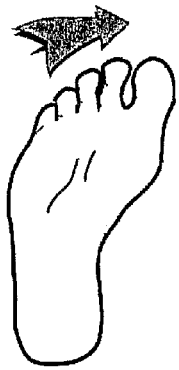

Heel support 14 supports the user's heel. Heel support 14 preferably provides a heel "cup" that receives a user's heel. Heel support 14 is supported on a bracket 52. As best seen in FIG. 1D, bracket 52 can be adjusted in the forward/backward direction as indicated by arrow 53 to accommodate different users having feet of different lengths. In the illustrated embodiment, bracket 52 has indentations 56 along its lower edges. The distance from heel support 14 to forefoot member 12 can be adjusted by moving bracket 52 until a pin 54 engages a selected one of indentations 56. Any other suitable mechanism may be provided to selectively lock heel support 14 at a desired position to accommodate the foot size of a given user. Foot sizes may be marked on base plate 22 to assist a user in finding the right position of heel support 14 for his or her foot.

A layer of rubber or similar high friction, user comfortable material may be placed on heel support 14 to minimize any movement of the user's heel.

It is not mandatory that heel support 14 provide a cup to fully receive a user's heel. In some embodiments, heel support 14 comprises a platform onto which a user can place his or her heel.

Heel support 14 may be rigidly fixed to bracket 52. In the alternative, heel support 14 and/or bracket 52 may be configured to permit heel support 14 to pivot as indicated by arrow 55 as a user moves the his or her forefoot up and down relative to his or her heel. Heel support 14 may optionally be coupled to frame 16 (or base 22) by a coupling that permits more than one degree of rotational freedom of heel support 14. For example, heel support 14 may be mounted by way of a ball-and-socket or universal coupler or the like that permits heel support 14 to twist from side-to-side as well as to rock forward and back.

Heel support 14 may optionally be height-adjustable to allow for variability in ankle range of motion between users and also to allow for stretching of the musculature of the lower leg and/or foot. A user may unlock a height adjustment mechanism, for example, by lifting a lever, move heel support 14 to a desired vertical position and then lock the height adjustment mechanism. In the alternative to adjusting the height of heel support 14, the height of forefoot member 12 may be adjustable by moving frame 16 relative to heel support 14 or by moving the locations at which resistance members 20 are supported on frame 16 up or down relative to frame 16.

Figure 3B:
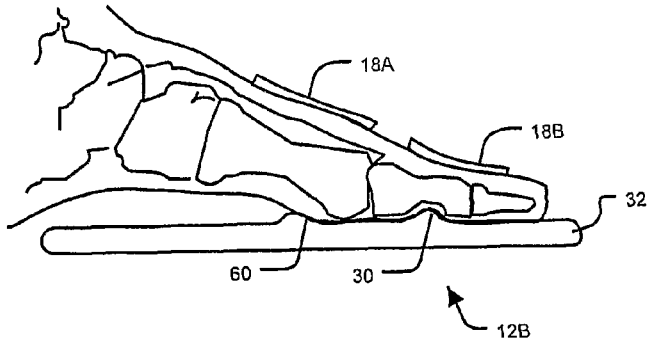
FIG. 3B is a longitudinal elevational sectional view of an alternative forefoot support having two foot-locating features.

A wide range of modifications are possible. Some non-limiting examples of such modifications are set out below. Forefoot member 12 may comprise multiple foot-locating features. For example, FIG. 3B shows a forefoot member 12A having an additional raised foot-locating feature 60 located proximal to ridge 30. A user can place his or her foot on forefoot member 12 so that the distal aspect of the arch of the user's foot is aligned with the center of raised feature 60. The ball of the user's foot is thereby located between ridge 30 and raised feature 60. This can help to ensure proper alignment of the distal metatarsals with respect to the resistance applied to the foot/ankle.

Various other departures from the illustrated embodiments are possible. For example:

Any suitable form of connection may be provided between resistance members 20 and forefoot member 12. For example, grommets, tunnels, or similar attachments may be provided on lateral edges of forefoot support 12 or traversing the underside of forefoot support 12. Resistance members 20 may be sewn, or attached by adhesive to forefoot member 12. Resistance members 20 may be attached to forefoot member 12 by clips, hooks, rivets or screws. Resistance members 20 are optionally detachable from forefoot member 12. In some embodiments forefoot member 12 can slide transversely at least slightly along resistance members 20.

Forefoot member 12 may comprise two sections including a toe section connected to a forefoot section by a piece of elastic material.

A rear end of forefoot member 12 may optionally be coupled to heel support 14 so that variations in the position of the resistance are possible, depending on the length of the user's foot. In this embodiment, users can adjust the position of heel support 14 so that the ends of their toes are aligned with the distal end of the forefoot support. Elastic material in the forefoot support stretches or contracts to suit the length of the user's foot.

Elastic resistance members 20 are not necessarily elastic all along their lengths. Resistance members 20 may comprise non-elastic sections, such as sections of cable or rigid links. In such embodiments, forces may be applied to forefoot member 12 by way of springs or powered actuators that pull on resistance members 20.

A foot exercise apparatus may optionally include one or more foot plates (not shown) that are attached to base 22. When a user is exercising one foot, the user can place the other foot on a footplate. This prevents the apparatus from moving around during use. The footplate may be pivotally or slidably mounted to base 22 so that it can be moved to project out of either side of base 22. For example, a foot plate may be pivoted outward from a central pivoting point or slid laterally to either side of the base 22, depending on which foot is being exercised. A foot plate is particularly useful in cases where the apparatus is very light in weight.

Apparatus according to the invention may be designed for use in a commercial setting like a gym. In some embodiments resistance to motions of the user's ankle, foot and/or toes is provided by weights or automatically controlled actuators. Such embodiments may be constructed in a manner similar to that shown in FIG. 1 with the exception that elastic resistance members 20 may be replaced by cables, bands, or other inelastic flexible members that are attached to forefoot member 12 at one end and are maintained under tension by weights, powered actuators, or the like. Tension may be adjusted by selecting appropriate weights or controlling the actuators. In such embodiments the forefoot support may be flexible or rigid.

Figure 4:
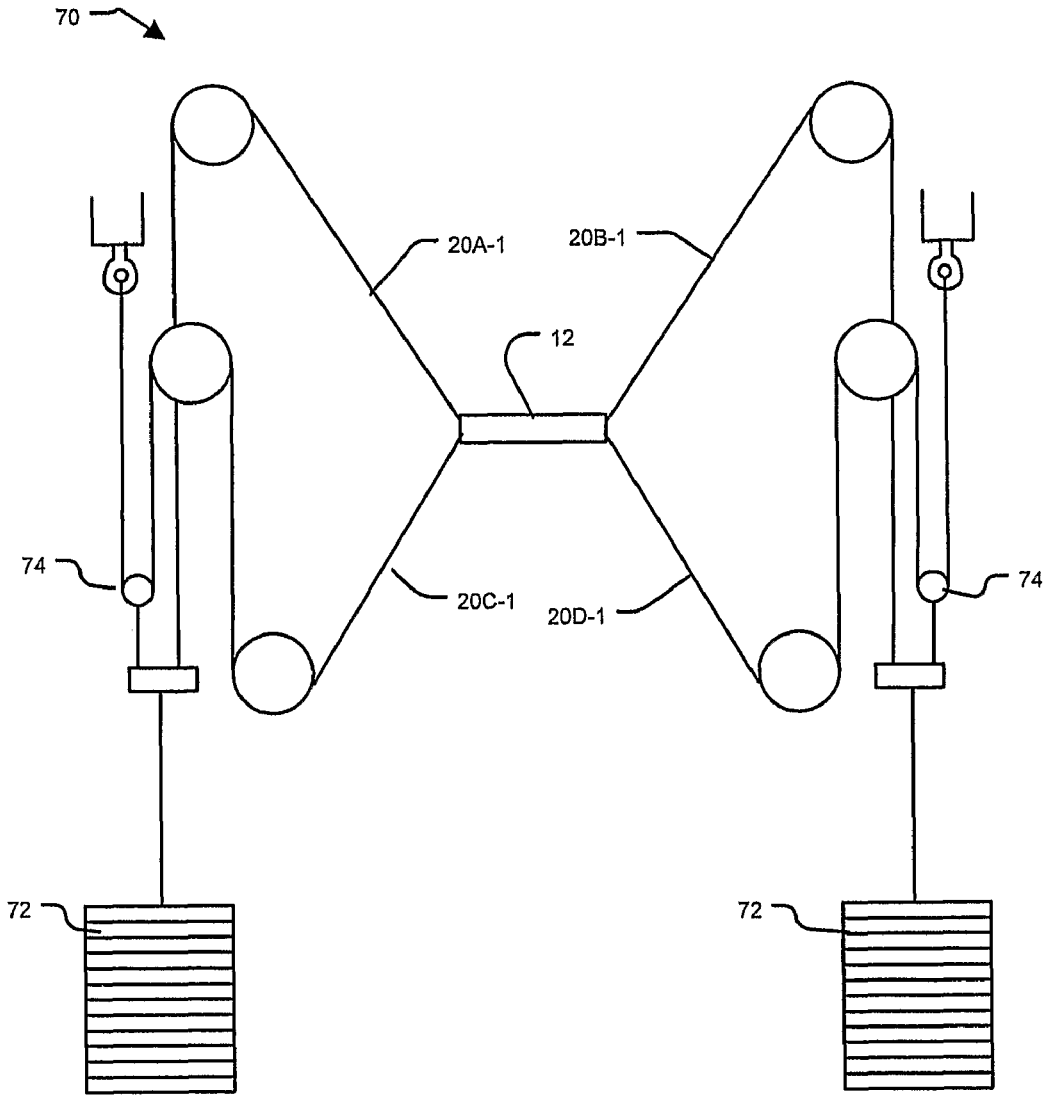
FIG. 4 is a schematic view of a foot exercise apparatus in which resistance to foot movements is provided by weights.

FIG. 4 shows schematically a foot exercise apparatus 70 in which tension is supplied by weights 72. Heel support 14 is omitted from FIG. 4 for clarity. Where tension is provided by weights, the same weights may supply resistance to resistance members 20A-1 and 20B-1 during plantarflexion as supplies resistance to resistance members 20C-1 and 20D-1 during dorsiflexion. A double pulley system 74 may be used to halve the resistance during the movement of dorsiflexion (upward movement), relative to the resistance during plantarflexion (downward movement), to compensate for the strength ratio between these two movements.

In some embodiments, some resistance members 20 are elastic while others are tensioned by weights, actuators, springs, compressed fluid, or gas or the like. Two or more of resistance members 20A-1, 20B-1, 20C-1, 20D-1, 20A-2, 20B-2, 20C-2, and 20D-2 may be provided by different segments of a single longer resistance member.

Some embodiments of the invention provide a rigid piece of material (not shown) mounted to heel support 14. The rigid piece of material extends longitudinally along approximately half the length of the foot in the direction of forefoot member 12. A strap, or similar means of attachment permits the user's foot to be held to the rigid piece, thereby preventing movements around the user's ankle joint. This embodiment allows the user to isolate movements of the toes.

A foot exercise apparatus may optionally have stops and/or guides to limit or determine a range of motion of the user's foot. For example, stop/guide members may be provided on a track attached to frame 16. The stop/guide members may be positioned above and/or below the user's forefoot to limit or determine a range of motion of the user's forefoot. The track may be provided with a scale. A clinician/user could use the scale to set a range of motion that is allowable or to determine improvements in a user's range of joint motion. In some embodiments, stops limit movement of forefoot support 12 to a desired range.

Any suitable securing mechanism may be provided to secure a user's toes and forefoot in place on forefoot member 12. In the illustrated embodiment, the securing mechanism comprises straps 18A and 18B. Straps 18A and 18B may be fastened over the user's foot with suitable fasteners such as Velcro™ or other hook-and-loop fastener material. Straps 18A and 18B are attached to one side of forefoot member 12. Straps 18A and 18B may pass through loops or similar attachments on the opposite side of forefoot member 12 and then pulled so that they are tight over the top of the user's foot and toes and then fastened to secure the user's foot and toes to forefoot member 12.

In some alternative embodiments of the invention, straps 18A and 18B are replaced or augmented by a foot piece (not shown), either in a slipper, boot, sandal or similar form. Such a foot piece may be made of a flexible material and attached to forefoot member 12. A foot piece may be sufficiently elastic to accommodate a wide range of foot sizes, yet have sufficient rigidity to maintain its shape and durability. A foot piece may have laces, straps or the like to permit it to be adjusted to hold feet of different foot sizes on forefoot member 12. The foot piece may be detachable from the forefoot member for ease of use and to permit cleaning.

Figure 5A:
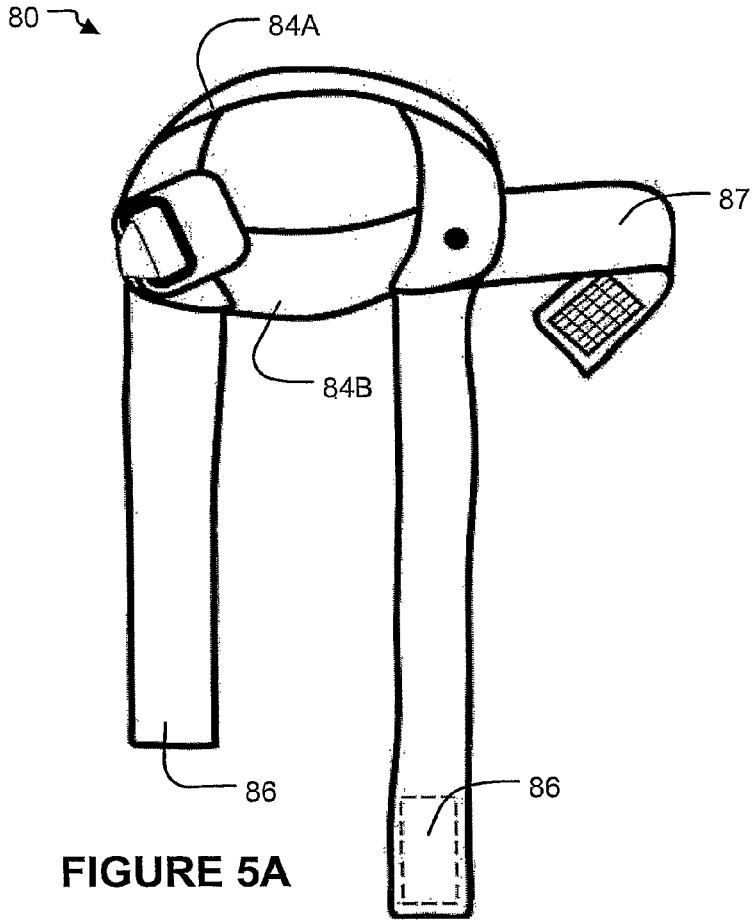
FIGS. 5A and 5B show a harness and cover that may be used to connect resistance members to a user's foot; and, FIG. 6 shows a portable foot exercise apparatus.
Figure 5B:
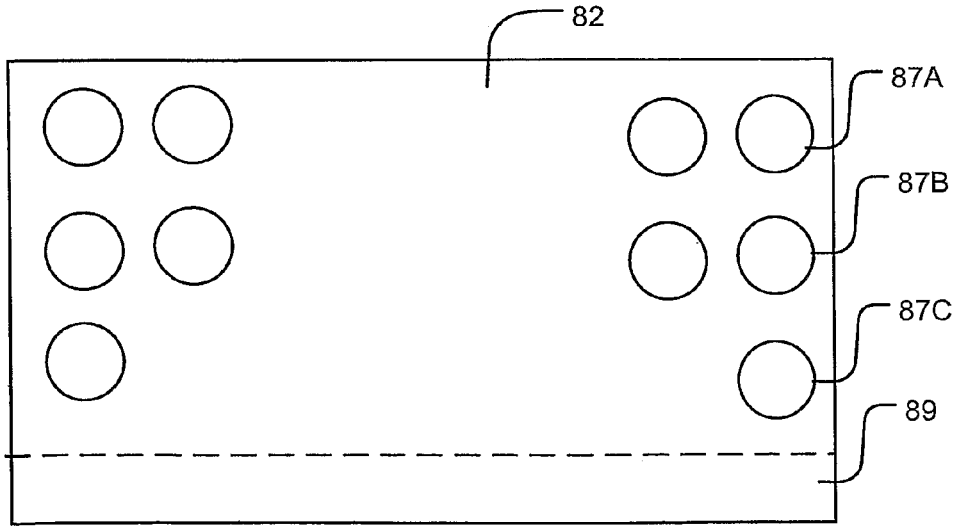

In other alternative embodiments of the invention resistance members 20 are attached to a user's foot by straps, harnesses or the like in the vicinity of the user's distal metatarsals and/or inter-phalangeal joints. One such embodiment is illustrated in FIGS. 5A and 5B. FIG. 5A shows a foot harness 80 to which resistance members 20 may be attached. In the illustrated embodiment, resistance members 20 are attached to harness 80 by a toe and forefoot cover 82 as shown in FIG. 5B. Foot harness 80 includes:

- a forefoot support 84 comprising two padded straps, or the like (84A and 84B) that are connected at their ends with rivets, or similar attachments, to allow for adjustment based on the size of the user's forefoot;
- a hook-and-loop strap 87 or similar means of attachment that can be buckled across the top of the user's forefoot (forefoot strap) to hold the straps 84 of the forefoot support below the forefoot; and,
- a heel strap 86 that is attached to forefoot support 84 and connectable at the proximal (heel) end with a hook-and-loop strap or the like to allow for adjustability according to the length of the user's foot.

Toe and forefoot cover 82 comprises a padded elastic material that can be placed over the user's toes and forefoot after harness 80 has been attached around the user's forefoot and behind the user's heel. The bottom of toe and forefoot cover 82 is attached to the plantar surface of forefoot support 84 while the top of toe and forefoot cover 82 is detachably affixed to a strip of Velcro™ or similar means of attachment on the dorsal surface of foot harness 80. Grommets 87 are disposed along lateral edges of toe and forefoot cover 82 at the approximate locations of the user's IP joint and the user's distal MT joints.

Grommets 87A receive resistance members 20 to provide resistance for the toes. Grommets 87B receive resistance members 20 to provide resistance for the foot/ankle. The locations of grommets 87 will vary depending on the size of the user's feet. Alternatively, eyelets or the like may be attached to the distal aspect of forefoot support 84 to receive resistance members 20 that provide resistance for the muscles of the foot and ankle (i.e. approximate location of the distal metatarsals). A "sleeve" 89 is provided at a rear of toe and forefoot cover 74 to prevent forward or backward movement of resistance members 20 during use. Additional eyelets 87C may also be provided in forefoot support 84 to receive one or more additional resistance members to provide additional resistance for ankle joint movements.

An otherwise rigid forefoot member may include a hinge and spring assembly to allow for movements of toe flexion and extension. Such a spring assembly may, for example, traverse a user's foot in a medial-lateral direction. The spring assembly may be located at the approximate position of the MTP joint.

Operation

To use apparatus 10 a user sets up apparatus 10 to suit their physical characteristics and exercise requirements. Setting up apparatus 10 may involve:

- adjusting the angle of frame 16 relative to base 22 until frame 16 is inclined slightly toward the user.
- setting tensioners 40 to levels appropriate for the user.
- seating the user behind the apparatus 10.
- measuring a length of the user's foot or a part of the user's foot (a scale may be provided on base 22 to allow the length of the user's foot to be measured—the scale may comprise a foot-locating feature like a feature 30 provided on forefoot member 12—the scale may be used to measure a location of the user's heel when the foot-locating feature of the scale is engaged with an anatomical feature of the user's foot, such as the joint of the user's great toe).
- adjusting the position of heel support 14 by lifting bracket 52 upwardly under heel support 14, and sliding bracket 52 in or out until pin 54 can be engaged in an indentation 56 corresponding to the measured size of the user's foot.
- having the user place his or her heel on heel support 14 and his or her forefoot on forefoot member 12. Where forefoot member 12 comprises a foot-locating feature (such as ridge 30) then the user aligns an anatomical feature of his or her foot with the feature 30.
- strapping the user's forefoot and toes to forefoot member 12 with straps 18A and 18B.
- adjusting the tilt of frame 16 to a desired angle and then locking the tilt at that angle by tightening clamp 49. The desired angle may be selected to provide a neutral starting position or to allow a full range of motion for a desired movement.
- Asking the user to move his or her foot in desired directions. For example, the user could be asked to move his or her foot in any of the directions illustrated on FIGS. 2B, 2C or 2D against the resistance offered by apparatus 10.

Readjusting tensioners 40, if necessary.

Having the user perform a desired number of repetitions.

Repeating with the user's other foot, if necessary or desired.

As treatment progresses, the resistance can be increased by setting tensioners 40 to provide greater tension and/or the user can move his or her foot and toes over a larger range of motion. Apparatus 10 may be used in a seated, standing, reclining, or supine position.

An apparatus 10 may be used to perform maximal strength testing of the foot. Elastic resistance members, weights, or other mechanism for providing resistance may be set to provide sufficient resistance that the apparatus may be used to evaluate the maximal strength level of a user for the various joint movements of the foot, toes, and ankle. Maximal strength testing can be used to evaluate the effectiveness of a strength training program and to determine the appropriate resistance settings, based on a percentage of maximal strength, for a strength training program.

Alternative Foot Exercise Apparatus

Figure 6:
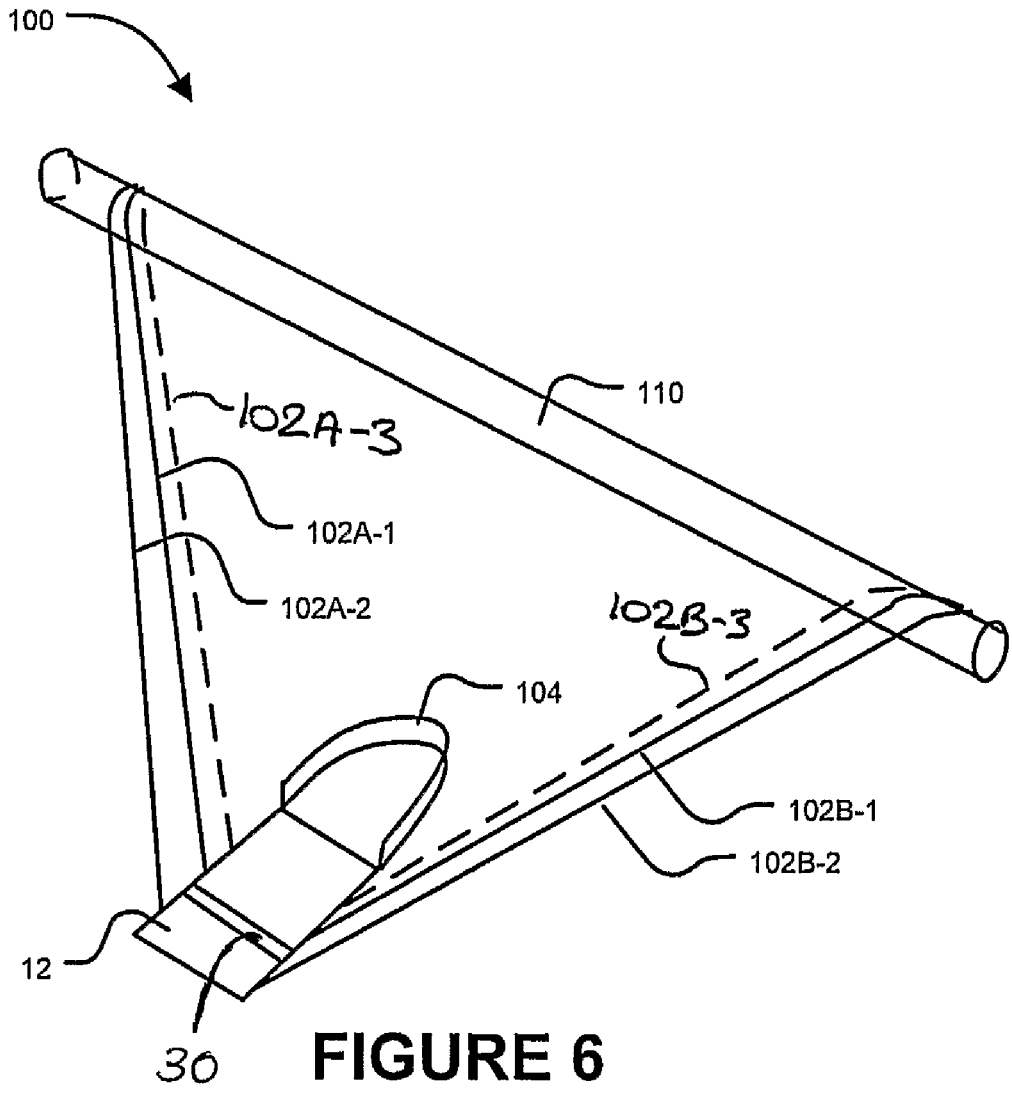

FIG. 6 shows an alternative foot and ankle exercising apparatus 100. Apparatus 100 has a forefoot support 12 and elastic resistance members 102 similar to resistance members 20 of FIG. 1. Apparatus 100 optionally includes a heel strap 104. Elastic members 102 are each attached at one end to a handle 110, which the user holds onto during use. Handle 110 may be a telescoping handle. Elastic members 102 are attached between attachment points near the ends of handle 110 and forefoot member 12.

Elastic members 102 form acute angles (for example, approximately 45 degrees) with handle 110. Thus, elastic members 102 provide resistance during ankle inversion/eversion as well as during plantarflexion of the foot.

During operation of apparatus 100, the user preferably sits on a flat surface with his/her legs flat against the surface (knees fully extended) and trunk upright while holding onto handle 110 at a position such that tension is maintained in elastic members 102. Alternatively, the user could use apparatus 100 while in a standing position. From either of these positions, the user may perform movements of ankle plantarflexion, ankle eversion/inversion, forefoot adduction/abduction, foot flexion, toe flexion, and combinations of these movements.

To increase the tension in elastic members 102, the user may either turn handle 110 to wind elastic members 102 around handle 110 or pull handle 110 in closer to the body. To increase tension further, the user may install elastic members which provide higher resistance. To monitor increases in resistance, the user may hold handle 110 at a constant distance from the foot (e.g. at knee level) and take note of the number of turns by which handle 110 is rotated. A tension gauge or other resistance measurement mechanism may optionally be attached in-line with one or more of elastic members 102 to enable a user to directly monitor any changes of the tension in elastic members 102 that would cause changes in resistance.

To strengthen the musculature during movements of ankle dorsiflexion, foot extension, and toe extension, the user can insert handle 110 on the opposite side of a door frame with the door closed, attach it to hooks or similar supports that are attached to a wall or similar surface, have a partner hold onto handle 110 or use some other similar form of attachment.

Apparatus 110 may also be used to stretch the musculature associated with the foot. This can be accomplished by relaxing the muscles while simultaneously applying tension to the device. Moving the foot, toes, and ankle in various directions can provide stretching to all of the associated musculature.

Handle 110 may be telescoping or may comprise a number of smaller sections attached to one another to allow for portability during storage or travel.

In the illustrated embodiment, either two or three pairs of elastic members 102 extend from handle 110 to forefoot member 12. One pair 102A-1 and 102B-1 connect to forefoot member 12 at a location just behind the user's MTP joint. A second pair 102A-2 and 102B-2 connect to forefoot member 12 at a location that is approximately aligned with the midpoint of the proximal phalanges of the user's first three toes. A third pair 102A-3 and 102B-3 optionally connects to forefoot member 12 at a location that is toward the user's heel relative to the second pair.

Another alternative foot exercise apparatus has an elastic webbing mesh system supported inside a housing (not shown). Tension in the webbing can be controlled by tensioners located on the exterior of the housing, or through use of webbing of different resistance levels. The elastic webbing is aligned in a cross pattern with superior and inferior segments to allow for multiple angle resistance to foot movements and greater enclosure of the foot. The mesh pattern of the webbing and the alignment of the meshing around the foot allows for resistance in multiple directions.

It can be appreciated that exercise apparatus as described herein may include various new and useful features. Such features may include one or more of:

A flexible forefoot bed/support that permits different degrees of resistance for movements about a user's ankle, foot, and toes.

A flexible forefoot bed/support with one or more raised surfaces (such as ridge 30) and/or one or more indentations to receive projecting parts of the foot. The raised surfaces and/or indentations allow for alignment of resistance with anatomical landmarks on the foot.

A multi-directional, variable resistance that provides resistance to movements of the foot, toes, and ankle in more than one plane and around more than one axis of rotation.

Apparatus that provides resistance to motions of various joints of the foot and ankle in different amounts, for example in amounts that approximate strength ratios between different joint movements.

Apparatus having features as described herein may be advantageous in various circumstances. For example, apparatus according to some preferred embodiments of the invention:

allows the user to exercise the ankle, foot and toes through a full range of all possible ranges of motion. This is important for complete strengthening and flexibility of the associated musculature and joints, respectively.

allows the user to perform combined ankle, foot, and toe movements. This is important for improving coordination of the associated musculature and developing functional strength.

allows the user to perform isolated ankle, foot, and toe movements. This is important for strengthening of specific tissues.

allows for progressive increases in resistance. This is important for proper strengthening of the associated musculature as well as safety and injury prevention.

allows the user to monitor resistance during isolated and combined movements. This is important for strength training and testing.

allows for full range of motion stretching of muscles/tendons associated with movements around the ankle, foot and toes. Stretching is an important adjunct for strength training and rehabilitation.

is easy to use and requires minimal adjustments in body position.

can be used entirely in a seated position, which is important for the elderly or people with limited mobility.

It can be appreciated that foot exercising apparatus as described herein may be used to provide inherent strengthening and stretching of the entire foot muscular system (all 4 layers), along with the ankle tendons and ligaments, and the three groups of muscles of the lower leg. Combined movements allow for improvements in coordinated movements in the foot along with providing multi-directional tendon and ligament strengthening. Improvements in strength and coordination are important for improving balance. Increases in resistance of the apparatus allows for graduated strengthening of the lower leg including the foot and ankle.

As will be apparent to those skilled in the art in the light of the foregoing disclosure, many alterations and modifications are possible in the practice of this invention without departing from the spirit or scope thereof.

What is claimed is:

1. Exercise apparatus comprising:

a forefoot member extending longitudinally between front and rear ends;

a plurality of resistance members connected to the forefoot member, the resistance members including a first set comprising:

a plurality of first resistance members connected to the forefoot member at a first longitudinal position, the first set including a plurality of the first resistance members extending in a superior direction relative to the forefoot member, the first resistance members including resistance members that extend in each of two opposed lateral directions from first and second opposing sides of the forefoot member; and a second set comprising one or more second resistance members connected to the forefoot member at a second longitudinal position toward the front end of the forefoot member from the first longitudinal position and extending in a superior direction relative to the forefoot member; and a foot-locating feature projecting in a superior direction on a superior face of the forefoot member at a location between the first and second longitudinal positions, the foot-locating feature comprising a transversely-extending ridge located and configured to be received under a user's toes;

wherein the forefoot member is flexible about at least one transversely-extending axis in its portion between the first and second longitudinal positions.

2. Exercise apparatus according to claim 1 wherein the resistance members comprise elastically-stretchable members.

3. Exercise apparatus according to claim 2 wherein the resistance members of the first set provide greater resistance to stretching than the resistance members of the second set.

4. Exercise apparatus according to claim 1 comprising a heel strap attached to the forefoot member.

5. Exercise apparatus according to claim 1 wherein ends of the resistance members remote from the forefoot member are coupled to a transversely-extending handle.

6. Exercise apparatus according to claim 5 wherein the handle is telescopic.

7. Exercise apparatus according to claim 5 wherein the handle comprises a plurality of sections that are detachably connected together.

8. Exercise apparatus according to claim 5 wherein the forefoot member is freely suspended by the resistance members and the resistance members extend at an angle of approximately 45 degrees to the handle.

9. Exercise apparatus according to claim 1 wherein the forefoot member is freely suspended by the resistance members.

10. Exercise apparatus according to claim 1 wherein the forefoot member comprises a reinforcement extending transversely across the forefoot member.

11. Exercise apparatus according to claim 1 wherein the second set of resistance members provide a resistance that is approximately ⅓ of a resistance provided by the first set of resistance members.

12. Exercise apparatus according to claim 1 comprising a scale connected to measure tension in one or more of the resistance members.

13. Exercise apparatus according to claim 1 wherein the second set of resistance members provide a resistance that is different from a resistance provided by the first set of resistance members.

14. Exercise apparatus according to claim 1 wherein the forefoot member is stiffer in torsion than it is about the transverse axis.

15. Exercise apparatus according to claim 1 wherein each of the first and second sets of the resistance members comprise one or more additional resistance members extending in an inferior direction relative to the forefoot member.

16. Exercise apparatus according to claim 15 wherein the resistance members comprise elastic members.

17. Exercise apparatus according to claim 15 wherein the forefoot member is suspended by the resistance members from a frame and the resistance members are connected to the frame at their ends remote from the forefoot member.

18. Exercise apparatus according to claim 1 wherein the second set of resistance members includes resistance members that extend in each of two opposed lateral directions from points on opposing sides of the forefoot member.

19. Exercise apparatus according to claim 18 wherein the resistance members include one or more resistance members that extend from the forefoot member in a first direction, one or more resistance members that extend from the forefoot member in a second direction opposed to the first direction, one or more resistance members that extend from the forefoot member in a third direction that is not parallel to either of the first or second directions and one or more resistance members that extend from the forefoot member in a fourth direction opposed to the third direction.

20. Exercise apparatus according to claim 19 when the first and third directions are bilaterally symmetrical with respect to a plane passing perpendicularly through the forefoot member.

21. Exercise apparatus according to claim 1 wherein the foot-locating feature coincides longitudinally with the transverse axis.

22. Exercise apparatus according to claim 1 wherein, for each resistance member in the first set of resistance members there is a corresponding resistance member in the second set of resistance members and the resistance members of the first set of resistance members provide more resistance than the corresponding resistance members of the second set of resistance members.

23. Exercise apparatus comprising:

a forefoot member attachable to a forefoot of a user;

a projecting foot-locating feature on a superior surface of the forefoot member; and a plurality of resistance members connected to the forefoot member, the resistance members including one or more resistance members extending in a superior direction relative to the forefoot member and one or more other resistance members extending in an inferior direction relative to the forefoot member;

wherein the forefoot member is flexible about a transverse axis and the forefoot member comprises a removable stiffener extending longitudinally along the forefoot member wherein, when the stiffener is in place, the forefoot member is stiffer with respect to flexing about the transverse axis than it is when the stiffener is removed.

24. Exercise apparatus comprising:

a forefoot member attachable to a forefoot of a user;

a projecting foot-locating feature on a superior surface of the forefoot member; and a plurality of resistance members connected to the forefoot member, the resistance members including one or more resistance members extending in a superior direction relative to the forefoot member and one or more other resistance members extending in an inferior direction relative to the forefoot member;

wherein:

the forefoot member is flexible about a transverse axis;

the plurality of resistance members comprises a first set of resistance members connected to the forefoot member on a forward side of the transverse axis and a second set of resistance members connected to the forefoot member on a rearward side of the transverse axis;

each of the first and second sets of resistance members comprise resistance members that extend in each of two opposed lateral directions from the forefoot member; and each of the first and second sets of resistance members include one or more first resistance members that extend from the forefoot member in a first direction, one or more second resistance members that extend from the forefoot member in a second direction opposed to the first direction, one or more third resistance members that extend from the forefoot member in a third direction that is not parallel to either of the first or second directions and one or more fourth resistance members that extend from the forefoot member in a fourth direction opposed to the third direction.

25. Exercise apparatus according to claim 24 wherein the first and third directions are bilaterally symmetrical with respect to a vertical plane passing through the forefoot member.

* * * * *